US010932324B2

(12) United States Patent
Höfer et al.

(10) Patent No.: US 10,932,324 B2
(45) Date of Patent: Feb. 23, 2021

(54) FLANGE ASSEMBLY FOR SECURING A HEATING DEVICE TO A FLUID CONTAINER

(71) Applicant: BLECKMANN GMBH & CO. KG, Lamprechtshausen (AT)

(72) Inventors: Johann Höfer, Lamprechtshausen (AT); Martin Reichl, Lamprechtshausen (AT); Peter Melcher, Lamprechtshausen (AT); Georg Görg, Lamprechtshausen (AT)

(73) Assignee: BLECKMANN GMBH & CO. KG, Lamprechtshausen (AT)

( * ) Notice: Subject to any disclaimer, the term of this patent is extended or adjusted under 35 U.S.C. 154(b) by 333 days.

(21) Appl. No.: 15/747,024

(22) PCT Filed: Aug. 1, 2016

(86) PCT No.: PCT/EP2016/068288

§ 371 (c)(1),
(2) Date: Jan. 23, 2018

(87) PCT Pub. No.: WO2017/021351

PCT Pub. Date: Feb. 9, 2017

(65) Prior Publication Data

US 2018/0220492 A1 Aug. 2, 2018

(30) Foreign Application Priority Data

Jul. 31, 2015 (EP) ..... 15179269

(51) Int. Cl.
*H05B 3/06* (2006.01)
*H05B 3/04* (2006.01)

(52) U.S. Cl.
CPC ..... *H05B 3/06* (2013.01); *H05B 3/04* (2013.01); *H05B 2203/021* (2013.01)

(58) Field of Classification Search
CPC ..... H05B 3/06; H05B 3/04; H05B 2203/021
See application file for complete search history.

(56) References Cited

U.S. PATENT DOCUMENTS 2,040,369 A 5/1936 Fischer
2,690,875 A 10/1954 Jenkins
(Continued)

FOREIGN PATENT DOCUMENTS

DE 100 62 539 B 9/1960
DE 1 112 792 B 8/1961
(Continued)

OTHER PUBLICATIONS

Machine Translation EP1111962, 2001, performed Feb. 7, 2020 (Year: 2001).*

*Primary Examiner* — Brian W Jennison
(74) *Attorney, Agent, or Firm* — Seed Intellectual Property Law Group LLP

(57) ABSTRACT

The present invention relates to a flange assembly for holding a heating device to a fluid container of an appliance accommodating a fluid to be heated, in particular a domestic appliance, comprising a flange unit arranged for being mounted to an opening of the fluid container by at least one fixing unit and having a non-sealing and a sealing and attachment position, wherein the flange unit is reversibly moveable from the non-sealing to the sealing and attachment position by means of the fixing unit for being configured to engage the opening of the fluid container in the sealing and attachment position, wherein the flange unit comprises a sealing element and a tensioning element, wherein the sealing element and the tensioning element are moveable relative to each other in an axial direction by means of the fixing unit such that the sealing element and the tensioning element can be pressed against each other, wherein the sealing element and the tensioning element are, in the
(Continued)

sealing and attachment position, arranged to provide a sealing in a sealing direction perpendicular to the axial direction, wherein the sealing element and/or the tensioning element of the flange unit comprise at least one tapered portion, wherein the tapered portion is arranged such that the relative movement of the sealing element and the tensioning element in the axial direction causes a predefined displacement of the tapered portion in the sealing direction. The invention further relates to a heating system including the flange assembly according to the present invention.

3 Claims, 14 Drawing Sheets

(56) References Cited

U.S. PATENT DOCUMENTS

| | | | | |
|---|---|---|---|---|
| 3,525,849 | A | 8/1970 | Bleckmann | |
| 3,777,777 | A | 12/1973 | Katchka | |
| 3,997,760 | A | 12/1976 | Salinger | |
| 4,621,186 | A | 11/1986 | Taylor et al. | |
| 4,707,590 | A | 11/1987 | Lefebvre | |
| 5,033,647 | A | 7/1991 | Smith et al. | |
| 5,497,906 | A | 3/1996 | Dubach | |
| 5,892,888 | A | 4/1999 | Romero | |
| 6,192,549 | B1 * | 2/2001 | Kasen | A47L 11/4011 15/320 |
| 6,852,963 | B2 | 2/2005 | Jeong | |

FOREIGN PATENT DOCUMENTS

| | | | | |
|---|---|---|---|---|
| DE | 1 851 911 | U | 5/1962 | |
| DE | 6 607 317 | U | 2/1971 | |
| DE | 1 952 282 | A1 | 4/1971 | |
| DE | 2 101 062 | A1 | 7/1972 | |
| DE | 26 10 512 | A1 | 11/1976 | |
| DE | 26 38 380 | A1 | 3/1978 | |
| DE | 36 21 295 | A1 | 1/1988 | |
| DE | 100 62 539 | A1 | 6/2002 | |
| EP | 0 086 465 | A1 | 8/1983 | |
| EP | 0 551 914 | A2 | 7/1993 | |
| EP | 1 111 962 | A2 | 6/2001 | |
| EP | 1111962 | A2 * | 6/2001 | H05B 3/06 |
| GB | 1 278 121 | A | 6/1972 | |

* cited by examiner

B-B

FLANGE ASSEMBLY FOR SECURING A HEATING DEVICE TO A FLUID CONTAINER

BACKGROUND

Technical Field

Embodiments of the present invention relate to a flange assembly for securing a heating device to a fluid container of an appliance accommodating the fluid to be heated, in particular a domestic appliance. Embodiments of the present invention further relate to a heating system including such flange assembly.

More specifically, the present invention relates to a flange assembly for holding a heating device to a fluid container of an appliance accommodating a fluid to be heated, in particular a domestic appliance, comprising a flange unit arranged for being mounted to an opening of the fluid container by at least one fixing unit and having a non-sealing and a sealing position and being reversibly movable from the non-sealing to the sealing position and vice versa by means of the fixing unit for being configured to engage the opening of the fluid container in the sealing position, wherein the flange unit comprises a sealing element and a tensioning element, wherein the sealing element and the tensioning element are moveable relative to each other in an axial direction by means of the fixing unit such that the sealing element and the tensioning element can be pressed against each other, wherein the sealing element and the tensioning element are, in the sealing position, arranged to provide a sealing in a sealing direction perpendicular to the axial direction.

Description of the Related Art

A flange assembly for securing a heating device according to the state of the art is described with reference to FIG. 1. In FIG. 1, a flange assembly 1000 is shown in an exploded view. Flange assembly 1000 which is used in practice at the present time comprises a cover unit 1010, a sealing element 1020, and a tensioning element 1030. These elements are tightened together by a fixing unit consisting of threaded pin or bolt 1040 and nut 1045. Further, there is provided a flat grounding plate 1070 for grounding flange assembly 1000. Finally, two through openings 1050 for inserting, for instance, a tubular heating device, and an insertion hole 1060 for inserting pin or bolt 1040 therethrough are provided.

Upon mounting the preassembled flange assembly 1000 in the mounting or installation opening of the fluid container of the domestic appliance (not shown), such as for example a washing machine or a dishwashing machine, nut 1045 is tightened upon pin 1040. As a result, tensioning element 1030 experiences a relative movement with respect to sealing element 1020 and compresses sealing element 1020 which is disposed between cover unit 1010 and tensioning element 1030. That causes the cross-section of sealing element 1020 to enlarge and to therefore seal off the entire system against the fluid container, while at the same time flange assembly 1000 is fixed to the mounting opening.

Flange assembly 1000 according to the state of the art suffers from disadvantages such as the large number of individual components, namely at least five, which comprise different materials and which are each to be produced separately. In addition, it is necessary to apply a relatively high force upon mounting flange assembly 1000 in order to ensure that flange assembly 1000 be securely sealed in relation to the container. For this reason, tensioning element 1030 has to be made of a robust and rigid material, such as a metal. By compressing massive elastic sealing element 1020, an undefined and thus unfavorable deformation of elastic sealing element 1020 occurs, such that a high force of compression is needed to compensate for the undefined deformation in order to ensure a secure sealing of flange assembly 1000 in relation to the container.

Moreover, by providing a massive sealing element 1020 and a metallic tensioning element 1030, high material costs occur. As generally flange assemblies or heating systems of that kind are subject to a high level of cost pressure, the number of components involved, the choice of material and the number of handling steps in pre-assembly and assembly to the fluid container have a great influence on the economic viability of the flange assembly or the heating system, respectively.

It has thus been an object of the present invention to provide a flange assembly and a heating system which, while affording the same or better efficiency and reliability, permit a reduction in manufacturing costs and provide for a predefined sealing in comparison with the previously known flange assemblies or heating systems.

BRIEF SUMMARY

In one embodiment, the present invention relates to a flange assembly for holding a heating device to a fluid container of an appliance accommodating a fluid to be heated, in particular a domestic appliance, comprising a flange unit arranged for being mounted to an opening of the fluid container by at least one fixing unit and having a non-sealing and a sealing and attachment position and being reversibly movable from the non-sealing to the sealing and attachment position and vice versa by means of the fixing unit for being configured to engage the opening of the fluid container in the sealing and attachment position, wherein the flange unit comprises a sealing element and a tensioning element, wherein the sealing element and the tensioning element are moveable relative to each other in an axial direction by means of the fixing unit such that the sealing element and the tensioning element can be pressed against each other, wherein the sealing element and the tensioning element are, in the sealing and attachment position, arranged to provide a sealing in a sealing direction perpendicular to the axial direction, wherein the sealing element and/or the tensioning element of the flange unit comprise at least one tapered portion, wherein the tapered portion is arranged such that the relative movement of the sealing element and the tensioning element in the axial direction causes a predefined displacement of the tapered portion in the sealing direction.

Since the sealing element and/or the tensioning element of the flange unit comprise at least one tapered portion, upon relative movement of the sealing element and the tensioning element in the axial direction, the tapered portion can be displaced in a sealing direction, which is preferably perpendicular to the axial direction. In other words, based on the geometrical shape of the tapered portion, it is possible to realize a predefined displacement of the tapered portion in response to the relative movement between sealing element and tensioning element. In other words, depending on the angle, shape or form of the tapered portion with respect to the axial direction, a transition between the axial direction and the sealing direction concerning the displacement of the tapered portion in the sealing direction can be adjusted. Thereby, it is advantageously possible to define, in particular predefine, the displacement of the tapered portion and therefore the sealing of the sealing element in the sealing and attachment position (or sealing position for short) in advance.

In this context, the axial direction preferably corresponds to an insertion direction in which the flange unit is mounted to or inserted into the opening of the fluid container.

In a different development, the tapered portion can present any arbitrary shape that allows a transmission from the relative movement in the axial direction to a displacement in the sealing direction perpendicular to the axial direction.

Preferably, the sealing position of the flange unit corresponds to a state, in which more pressure is applied between the sealing element and the tensioning element than in a state corresponding to the non-sealing position. Thereby, it is thus possible to employ the pressure applied in the sealing position for displacing the tapered portion.

In a further development of the flange assembly according to the present invention, the flange unit is made of a non-metallic material, wherein the sealing element is made of the same or of a softer non-metallic material than the tensioning element.

By providing the flange unit of the non-metallic material, costs and manufacturing effort can be reduced. Further, by providing the sealing element of the same non-metallic material or a softer non-metallic material than the tensioning element, displacement in the sealing direction implied by relative movement of sealing element and tensioning element in the axial direction preferably occurs at the sealing element and not the tensioning element.

The non-metallic material is preferably a plastic material. Since the non-metallic material is preferably a plastic material, material properties such as elasticity and the like can readily be selected. It is further preferred that the flange unit be manufactured by means of injection molding or a different process of manufacturing known in the art. Particularly injection molding allows for relatively complex forms and shapes to be easily and cost efficiently manufactured.

In one embodiment, the sealing element and/or the tensioning element comprise hollow sections.

Hollow sections in this context are sections surrounded by the respective element in at least four out of six possible orthogonal directions. By providing hollow sections, the respective section is not provided with material and the sealing element and/or the tensioning element can thus be manufactured using less material. The respective element and therefore the flange assembly can thus be manufactured of less material and thus less expensively. It should be noted that providing hollow sections and at the same time ensuring the defined sealing deformation is feasible due to the tapered portions providing the defined deformation upon the application of pressure thereon.

In a further development of the flange assembly according to the present invention, at least a part of the surface of the sealing element facing the tensioning element comprises a tapered sealing portion and/or at least a corresponding part of the surface of the tensioning element comprises a corresponding tapered tensioning portion, wherein the tapered sealing portion and/or the tapered tensioning portion are arranged such that the relative movement of the sealing element and the tensioning element in the axial direction causes a defined displacement of the tapered sealing portion and/or the tapered tensioning portion in the sealing direction.

Since in this development the tapered portion is provided at the surface facing the sealing element or the tensioning element, and not, for instance, on an opposite side thereof, the tapered portion is directly contacted by the other of the sealing element and the tensioning element upon movement of the two elements relative to each other. Thus, predefined stress and load between the tensioning element and the sealing element at the tapered portion and eventually the sealing can be achieved in an advantageous manner.

Preferably, the tapered portion is provided on both a surface of the sealing element and the tensioning element, such that the tapered portion of the sealing element contacts the tapered portion of the tensioning element upon relative movement therebetween. Since in this development the contacting surfaces correspond to each other, it is advantageously possible to predefine the displacement and eventually the sealing more precisely.

In a further development of the flange assembly according to the present invention, the outer peripheral wall portion is provided at an outer circumferential edge of the sealing element and the tensioning element, respectively.

In this development, the tapered portion is preferably located at the outer peripheral wall portion provided on an outer circumferential edge of the sealing element and the tensioning element, the tapered portion and thus eventually the realized sealing can be provided between the flange assembly and the opening of the fluid container of the appliance. In particular, if the flange assembly is mounted within the opening of the fluid container, the wall of the sealing element can abut the opening of the fluid container from an inner side thereof such that the tapered sealing portion displaced radially outwardly provides for a tight sealing between the flange unit and the opening of the fluid container.

Preferably, the wall of the tensioning element has a smaller circumference then the wall of the sealing element and abuts the wall of the sealing element from an inner side thereof. The respective wall portions preferably protrude axially in the axial direction on the radially outward edge of the sealing element and the tensioning element. Thereby, the wall of the sealing element is preferably supported against the opening of the fluid container in the radial direction by a part of the wall of the tensioning element.

Yet, in order for the tapered tensioning portion to be in the position corresponding to the tapered sealing portion in the axial direction, i.e., to overlay the tapered sealing portion upon projection in the axial direction, the tapered tensioning portion is directed radially outward from the wall portion of the tensioning element, such as to overlay the tapered sealing portion in the axial direction. In other words, it is preferred that the tensioning wall portion comprise a portion, corresponding to the portion farthest from the base portion of the tensioning element, having the same circumference and same shape as the wall of the sealing element but being axially displaced in the axial direction.

In a preferred development, the wall portion is provided at the complete or entire outer peripheral circumferential edge of the base portion of the sealing element and the tensioning element, respectively. Thereby, a tight sealing of the fluid container can be achieved about the entire peripheral circumference of the opening of the fluid container.

In a further development of the flange assembly according to the present invention, the flange unit comprises at least one through opening extending through the sealing element and the tensioning element in the axial direction.

Since the at least one through opening extends through the sealing element and the tensioning element it is possible for elements to be inserted into the fluid container through the flange unit in the axial direction.

In a preferred development, the through opening is arranged and provided for receiving and holding a heating device or a temperature sensor therethrough.

By receiving and holding or in other words securing a heating device or a temperature sensor in the through opening of the flange unit it is possible to provide the inside of the fluid container with the heating device or a temperature sensor, respectively.

In a further development of the flange assembly according to the present invention, the sealing element comprises a tapered portion surrounding the through opening and being arranged such that, in the sealing position, the defined displacement of the tapered portion in the sealing direction holds the heating device or the temperature sensor within the through opening.

Since the sealing element comprises a tapered portion that surrounds the through opening and that displaces in the sealing direction towards the heating device or temperature sensor inserted within the through opening, the inserted element can be tightened and fastened at its position within the through opening.

Accordingly, it is thus possible to securely receive and hold the heating device or the temperature sensor within the through opening, without need for further manufacturing or assembly steps.

In a further development of the flange assembly according to the present invention, the tapered portion comprises a sealing lip, provided at the inner peripheral surface of the at least one through opening.

By providing a sealing lip at the inner peripheral surface of the at least one through opening in the tapered portion of the sealing element, the elements inserted through the through opening, such as the heating device or the temperature sensor, can be readily sealed such that no fluid from the inside of the fluid container can leak to the outside thereof. Advantageously, by providing the sealing lip, no use of glue, adhesive etc., which would require additional manufacturing or assembly steps, becomes necessary.

Preferably, the sealing lip is configured as an O-ring sealing lip. An O-ring sealing is widely recognized as a well-known and secure form of a sealing which provides a reliable seal. Moreover, the displacement of the tapered portion can account for an additional sealing in addition to the O-ring sealing in one development.

In a further development of the flange assembly according to the present invention, the sealing element comprises a fixing unit opening and the tensioning element comprises a blind hole at corresponding positions along the axial direction for receiving at least part of the fixing unit therein.

Since the blind hole is formed in the tensioning element, no liquid connection is created from the front surface of the sealing element through the fixing unit openings of the cover unit and the sealing element to the inside of the fluid container. In other words, the blind hole is provided such that no liquid from the inside of the fluid container can leak to the outside despite the provision of the fixing unit.

Preferably, the blind hole is configured as a tapped blind hole. As the blind hole is configured as a tapped blind hole, part of the fixing unit provided within the tapped blind hole can be provided with a corresponding thread such that the relative movement of sealing element and tensioning element and thus the transition from non-sealing to sealing position of the flange unit can easily be realized by means of the tapped blind hole cooperating with a corresponding part of the fixing unit.

In a further development of the flange assembly according to the present invention, the fixing unit is arranged to provide a sealing in a sealing direction parallel to the axial direction.

In a further development of the flange assembly according to the present invention, the sealing element comprises a tapered portion around the fixing unit opening which is arranged to displace radially to the inside of the fixing unit opening upon relative movement between the sealing element and the tensioning element.

By providing the tapered portion around the fixing unit opening, also the fixing unit provided within the fixing unit opening can be tightened in case the sealing element and the tensioning element are moved towards each other. In other words, the tapered portion around the fixing unit opening accounts for a secure retaining of the fixing unit in the sealing position of the flange unit.

Preferably, the tapered portion displaces radially to the inside of the fixing unit opening by pressure applied from a corresponding tapered portion of the tensioning element. By providing a corresponding tapered portion of the tensioning element, it is advantageously possible to precisely define the retaining force applied by the tapered portion radially to the inside of the fixing unit opening of the sealing element.

In a further development of the flange assembly according to the present invention, the tensioning element comprises at least one support wall portion that extends radially outward from the blind hole for transferring pressure applied by the fixing unit at the blind hole over the tensioning element.

Since the tensioning element comprises at least one support wall portion that extends from the blind hole radially outward and transfers or distributes pressure applied to the tensioning element by the fixing unit, more precisely pressure applied at the blind hole of the tensioning element, no massive tensioning element is needed. It is thus advantageously possible to save material, weight and thus cost of the entire flange assembly. In other words, the support wall portion allows for the base portion of the tensioning element to be provided with less thickness in the axial direction, as pressure induced by the relative movement between tensioning element and sealing element, which could bend the base portion without the provision of a support wall portion, gets transferred to the radially outward positions with reference to the blind hole, by means of the support wall portion without bending the base portion of the tensioning element. It is thus possible to efficiently spread and distribute the pressure applied by the fixing unit over a larger portion of the tensioning element, preferably the entire tensioning element.

In one development, the sealing element is formed as a single piece and the tensioning element is formed as a single piece. However, in other developments the sealing element and the tensioning element can be formed as a single piece integral flange unit or the tensioning element and/or the sealing element can be formed of multiple pieces, respectively.

In a further development, the flange assembly according to the present invention comprises a cover unit provided in front of the flange unit in the axial direction, such that the sealing element is located between the cover unit and the tensioning element.

By providing a cover unit, it is possible to tension the sealing element between the cover unit and the tensioning element. The cover unit can thus provide support for the sealing element for pressure applied on the sealing element by the fixing unit.

In a further development of the flange assembly according to the present invention, the cover unit comprises through openings at positions corresponding to any through holes or blind holes formed in the flange unit.

In this development, the cover unit is preferably placed on the outside of the fluid container on the sealing element and eventually on the tensioning element in the axial direction. By comprising through openings at positions corresponding to any through holes or blind holes formed in the flange unit, such as a heating device insertion opening, a temperature sensor insertion opening and a fixing unit through opening, the respective elements or devices can be readily provided and inserted without difficulties, even if the cover unit is provided on top of the flange unit.

In a further development of the flange assembly according to the present invention, the sealing element is arranged to be pressed against the cover unit in the sealing position.

Preferably, the sealing element comprises at least one tapered portion provided adjacent the cover unit.

By providing at least one tapered portion adjacent the cover unit, a defined displacement of the tapered portion in the sealing direction can also be employed at the contacting surface of sealing element and cover unit. Advantageously, an improved sealing connection thus results also between the sealing element and the cover unit.

In a further development of the flange assembly according to the present invention, the fixing unit comprises a ground connecting element for connecting the flange assembly with ground.

In a further development of the flange assembly according to the present invention, the cover unit comprises an outer circumferential side wall, having a larger diameter than the flange unit. In this development, the flange unit preferably comprises a supporting portion arranged for contacting the appliance in the axial direction when mounted.

In other words, the flange assembly is arranged for being mounted to the opening of the fluid container from the outside of the fluid container in the axial direction. Upon tensioning the tensioning element against the sealing element, a sealing between the flange assembly and the opening of the fluid container is formed in the sealing direction perpendicular to the axial direction. Upon mounting the flange assembly, before tensioning, the supporting portion formed in the sealing element contacts the opening of the fluid container or the like of the appliance in the axial direction. Accordingly, the supporting portion is formed radially outwardly protruding from the side wall of the supporting element, which is arranged for contacting the opening of the fluid container in the sealing direction. Since the cover unit has an outer circumferential side wall with a larger diameter than the flange unit, the supporting portion can easily be formed in the space between the side wall of the flange unit, respectively the sealing element thereof, and the side wall of the cover unit.

In a further development of the flange assembly according to the present invention, the fixing unit is resilient, and the fixing unit preferably comprises at least one of a self-tapping screw, a threaded screw, a threaded bolt and nut, a knee lever, a speed nut and a snap connector.

By providing a resilient fixing unit, it is easily possible to dismount and loosen the flange assembly from the fluid container, such as for maintenance purposes or the like. With the selection of the particular fixing unit, particular needs of the application, such as easy and fast mounting and dismounting, replacement, and the like, can be accounted for.

In a further development of the flange assembly according to the present invention, a protruded portion is provided at the sealing element to engage with the tensioning element. The protruded portion ensures that the sealing element engages with the appliance wall as well as the tensioning element in the sealing position even if the appliance wall is beveled to ease mounting of the assembly components. The protruded portion compensates the missing material of the appliance wall.

Preferably, the tensioning element comprises a corresponding grooved portion in which the protruded portion of the sealing element can engage in the attachment position. In this arrangement the sealing element is to be clamped onto the tensioning element during assembly.

In a different embodiment of the invention, a heating system is provided including at least one heating device for heating a fluid, in particular in a domestic appliance, a flange assembly according to the present invention for holding the heating device, and a fluid container for accommodating the fluid to be heated by the heating device, wherein the fluid container has at least one through opening for passing the heating device therethrough and for mounting the flange assembly.

Since the heating system according to this embodiment is provided including the flange assembly according to the present invention, all the advantages and benefits of the flange assembly described above are also present in the heating system of this embodiment. In particular, the heating system according to the present invention allows for a more cost-efficient heating system, since no metallic sealing and tensioning elements are needed. Further, the mounting and dismounting of the flange assembly to and from the heating system is improved with respect to the prior art heating systems, since no huge sealing force is to be applied to the fixing unit. Finally, also a more reliable sealing is achieved due to the predefined and predetermined displacements of the flange unit towards the fluid container providing the seal between inside and outside of the fluid container.

BRIEF DESCRIPTION OF THE SEVERAL VIEWS OF THE DRAWINGS

Further advantages and preferred embodiments of the present invention will be described in the following together with the drawings listed below.

In the drawings.

DETAILED DESCRIPTION

Figure 1:
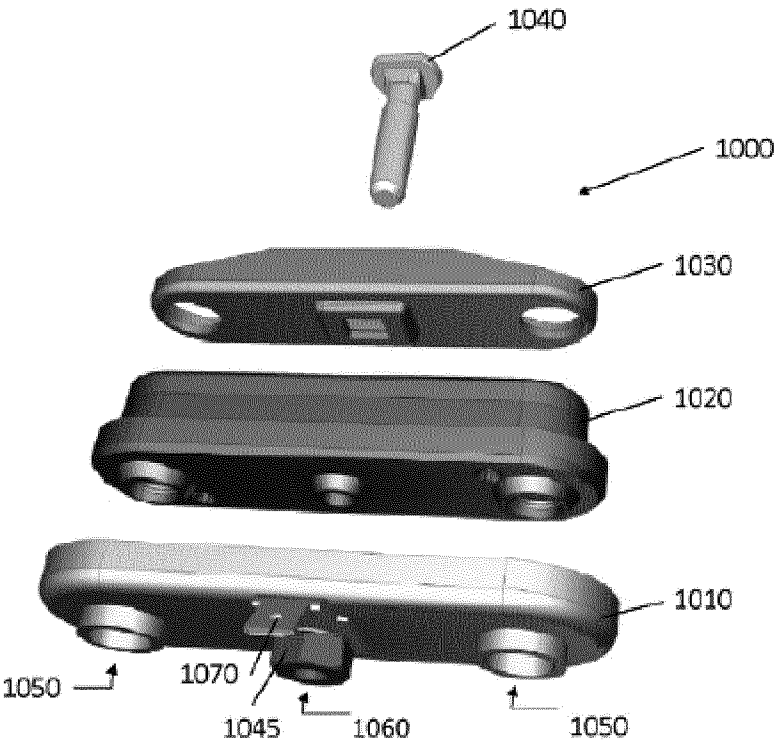
Fig. 1 (prior art)
FIG. 1 illustrates a flange assembly in exploded view according to the state of the art.
Figure 2A:
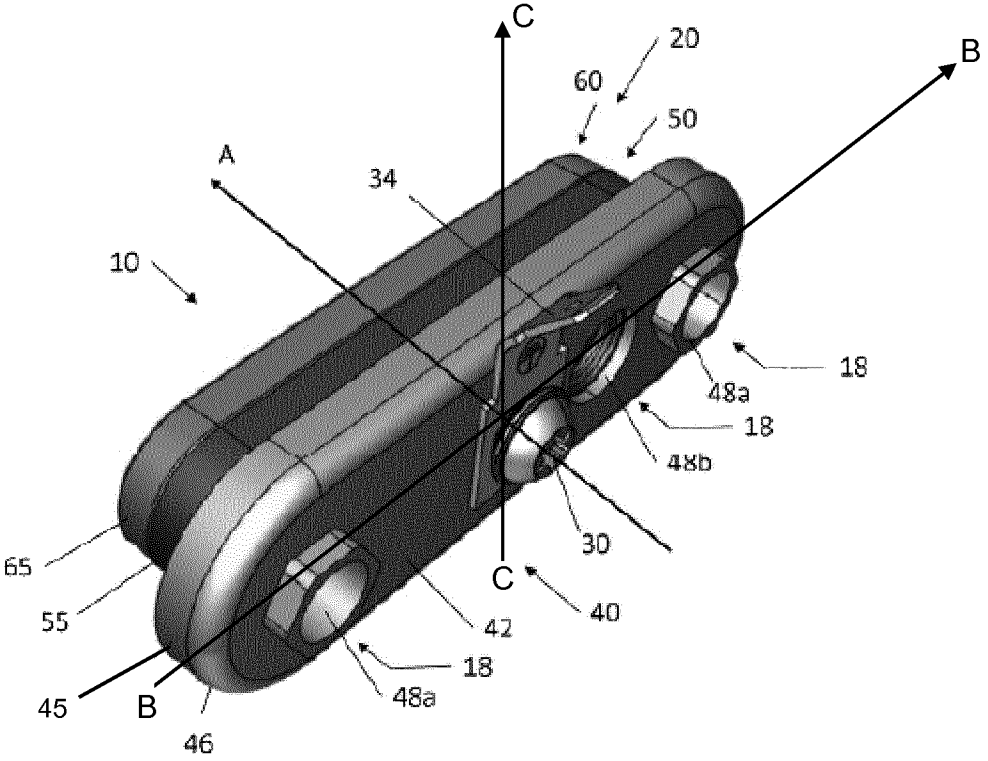
FIGS. 2*a* and 2*b* illustrate perspective views of the flange assembly according to the present invention from different angles of view.
Figure 2B:
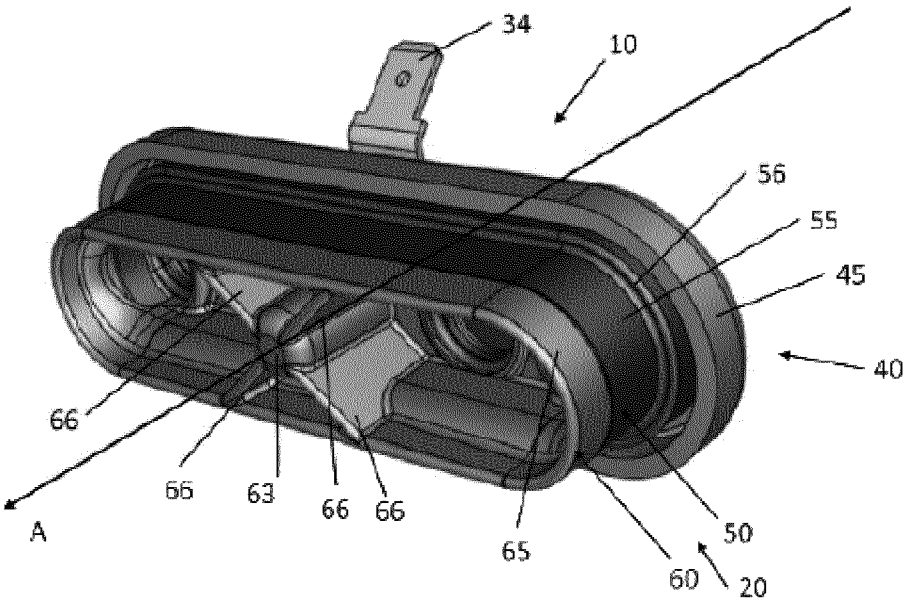

First, an exemplary flange assembly 10 for securing a heating device (not shown, except partially in FIGS. 4*a*, 4*b*) to a fluid container (not shown, except partially in FIGS. 4*a*, 4*b*) of an appliance accommodating a fluid to be heated is described with reference to FIGS. 2*a* and 2*b*. FIGS. 2*a* and 2*b* show three-dimensional perspective views of the flange assembly 10 in anon-sealing position.

The exemplary flange assembly 10 comprises a flange unit 20, a fixing unit 30 and a cover unit 40. Flange unit 20 comprises a sealing element 50 and a tensioning element 60. In an axial or insertion direction A, which corresponds basically to an axial direction of fixing unit 30 from a surface side of cover unit 40 to the rear of flange assembly 10, cover unit 40 abuts sealing element 50, which abuts tensioning element 60, respectively.

Fixing unit 30 comprises in this example a screw 31 for linking and tensioning sealing element 50, tensioning element 60 and possibly cover unit 40 as will be detailed below. A ground connecting portion 34 is provided in proximity to screw 31 for connecting flange assembly 10 to ground.

On the front surface of cover unit 40, which is the surface side to be provided outside the fluid container of the appliance to which flange assembly 10 is arranged for being mounted, cover unit 40 comprises a substantially flat base plate 42 with a rounded rectangular shape. An outer peripheral side wall 45, which extends in axial direction A towards the rear of flange assembly 10, is linked to the outer circumference of base plate 42 via rounded edge 46. Cover unit 40 preferably comprises a plastic material, such as a thermosetting plastic or polymer, which can be manufactured, for instance, by injection molding or a different suitable process known in the art. However, also different materials, such as materials comprising or consisting of metal or thermoplastic components, are considered.

Behind and adjacent to cover unit 40 in axial direction A, sealing element 50 and tensioning element 60 are provided. In FIG. 2*a*, outer peripheral side wall 55 of sealing element 50 and further behind sealing element 50 in axial direction A also outer peripheral side wall 65 of tensioning element 60 can be seen. Outer peripheral side walls 55 and 65 correspond substantially to the rounded rectangular shape of outer peripheral side wall 45 of cover unit 40 and protrude substantially parallel thereto in axial direction A with a smaller circumference however. In this example, upon mounting of flange assembly 10 to a fluid container of the appliance, outer peripheral side wall 45 is larger than the opening of the fluid container such that flange assembly 10 does not fall into said opening, whereas outer peripheral side walls 55 and 65 fit and get inserted therein. Nevertheless, in other examples the shape of outer peripheral side wall 45 may also be different.

As mentioned above, flange assembly 10 is shown in a non-sealing position. Therefore outer peripheral side wall 55 smoothly migrates to outer peripheral side wall 65, such that a substantially homogeneous outer peripheral surface of sealing element 50 and tensioning element 60 is formed.

Through openings 18, through which another component, such as the heating element or heating device which is to be secured or held to the fluid container of the appliance, can be inserted, are formed through flange assembly 10 in axial direction A. At the positions corresponding to through opening 18, two heating device mounting openings 48*a* for inserting a heating device (not shown) there through and a temperature sensor opening 48*b*, through which a temperature sensor (not shown) is insertable, are respectively provided in cover unit 40.

Flange unit 20 and thereby sealing element 50 and tensioning element 60 comprise openings or through holes at positions respectively corresponding to heating device openings 48*a* and temperature sensor opening 48*b* of cover unit 40 in axial direction A, such that the respective elements can readily be inserted through cover unit 40 and flange unit 20.

FIG. 2*b* shows flange assembly 10 from a rear side in mounting or axial direction A thereof. Protruding radially outward from outer peripheral side wall 55 on cover unit 40 side thereof, there is provided an appliance support 56. Appliance support 56 extends thus from peripheral side wall 55 in a direction towards peripheral side wall 45 and is arranged such that the appliance contacts therewith when flange assembly 10 is mounted to the fluid container of an appliance. Appliance support 56 becomes also apparent from FIG. 5 and will be described later in more detail.

It should be noted that peripheral side wall 45, peripheral side wall 55, and peripheral side wall 65 are preferably provided about the entire circumferential edges of cover unit 40, sealing element 50 and tensioning element 60, respectively.

From a backside of tensioning element 60, which is the side opposite to the side adjacent to sealing element 50 in axial direction A, a fixing unit receptacle 63 can be seen, which is provided substantially in the center and spreading therefrom towards the outer circumferential side wall 65 there are provided four support wall portions 66. Screw 31 of fixing unit 30 is inserted from the front surface of base plate 42 into fixing unit receptacle 63. Support wall portions 66 stabilize tensioning element 60 and account for a transfer and distribution of any pressure applied by fixing unit 30 to fixing unit receptacle 63 over the entire tensioning element 60.

Figure 3A:
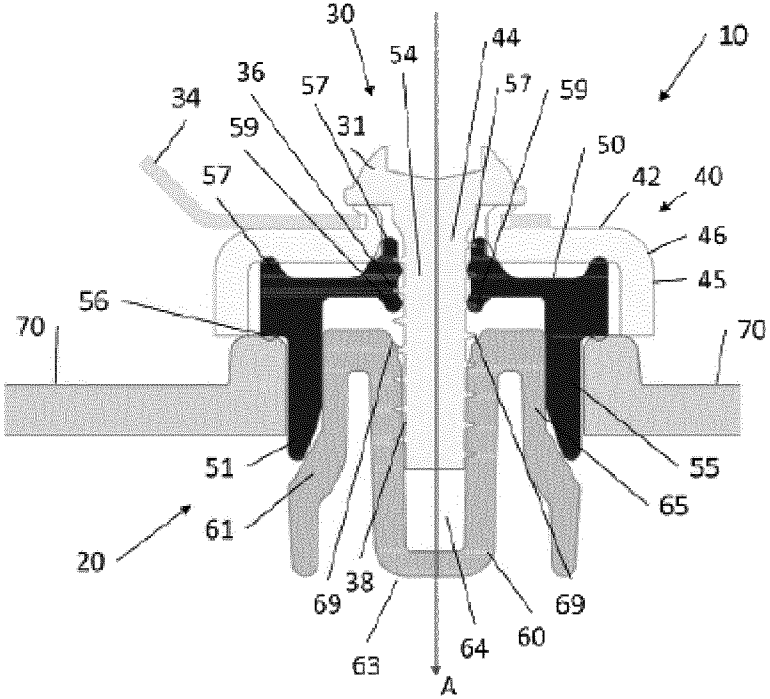
FIGS. 3*a* and 3*b* illustrate a first cross-sectional view of the flange assembly according to the present invention in a first direction in a non-sealing and a sealing and attachment position, respectively.
Figure 3B:
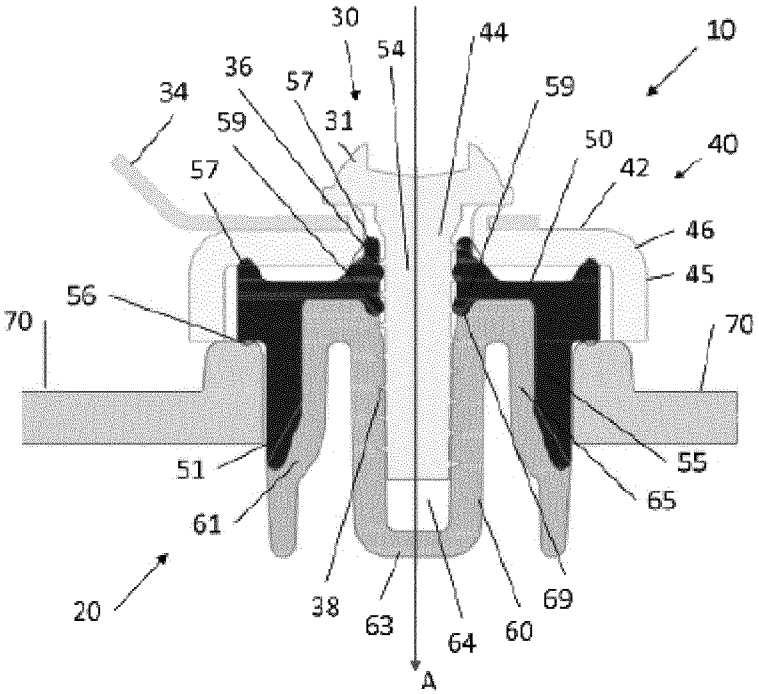

FIGS. 3*a* and 3*b* illustrate a cross-sectional view through flange assembly 10 as seen in FIGS. 2*a* and 2*b* in a vertical direction, which is the side with shorter side length of flange assembly 10. FIG. 3*a* shows the cross-section of flange assembly 10 in a non-sealing position, wherein FIG. 3*b* illustrates the same cross-section of flange assembly 10 in a sealing and attachment position or tightened state.

FIGS. 3*a* and 3*b* show flange assembly 10 in contact with an opening of an appliance 70. More precisely, appliance support 56 of sealing element 50 and outer peripheral side wall 45 of cover unit 40 are provided in proximity and partly in contact with the appliance in axial direction A corresponding to the insertion direction of screw 31 of fixing unit 30. Further, outer peripheral side wall 55 of sealing element 50 contacts the opening of appliance 70 on a circumferential side thereof.

Further to the elements indicated and illustrated in FIGS. 2*a* and 2*b*, a reception hole for screw 31 formed in cover unit 40 and flange unit 20 is visible. The reception hole is formed by a fixing unit opening 44 through cover unit 40 and a fixing unit opening 54 through sealing element 50 and ends as a blind hole 64 in tensioning element 60. Blind hole 64 is formed to the inside of fixing unit receptacle 63, which is visible from the outside in FIG. 2*b*. Thereby, no fluid connection from the outside to the inside of flange assembly 10 is enabled through fixing unit 30.

Surrounding screw 31, a thread 36 and a thread 38 is formed in sealing element 50 and tensioning element 60, respectively. Threads 36, 38 are in this example provided at the time of manufacturing into sealing element 50 and tensioning element 60, respectively.

It can be seen from FIG. 3 that tensioning element 60 is provided behind sealing element 50 in axial direction A, corresponding to a direction normal to base plate 42 of cover unit 40 and, as mentioned above, corresponding to the insertion direction of screw 31. Both sealing element 50 and tensioning element 60 comprise a substantially planar base portion, extending from blind hole 64 in a radially outward directed direction, and an outer peripheral side wall 55, 65 in continuance of the planar portion and protruding therefrom substantially in axial direction A towards the rear of flange assembly 10. In this view, the respective base portions of sealing element 50 and tensioning element 60 appear relatively smaller than the side walls protruding therefrom. However, this can be different in other examples and is also different in the lateral cross sectional view described with reference to FIGS. 4*a* and 4*b* below.

Outer peripheral side wall 55 includes a tapered portion 51 at or near the end thereof, which is the part of outer peripheral side wall 55 having the largest distance from cover unit 40 in axial direction A. The tapered direction is such arranged that tapered portion 51 becomes thinner from the radial inside to the radial outside towards the rear of flange assembly 10 that is with increased distance from cover unit 40.

Outer peripheral side wall 65 is formed parallel and abuts outer peripheral side wall 55 in a first section thereof, namely the foremost section of outer peripheral side wall 65. This first section parallel to outer peripheral side wall 55 of outer peripheral side wall 65 is approximately the same length as the outer peripheral side wall 55. However, outer peripheral side wall 65 is not planar over its entire extension, but presents outwardly directed tapered portion 61 at an axial position approximately corresponding to tapered portion 51 of sealing element 50. Further to the rear of flange assembly 10, there is provided a portion of peripheral side wall 65 protruding coaxially with outer peripheral side wall 55 in axial direction A.

Sealing element 50 comprises further tapered portions 57 and 59. Tapered portions 57 are provided in a front area of flange assembly 10, i.e., on the surface side of sealing element 50 contacting cover unit 40. Tapered portion 59 is provided surrounding fixing unit opening 54. Corresponding to tapered portion 59, there is also provided a tapered portion 69 in the tensioning element 60, surrounding blind hole 64 on the front side of tensioning element 60.

FIG. 3*b* shows flange assembly 10 in a sealing and attachment position (or sealing position for short). A transition from the non-sealing position shown in FIG. 3*a* to the sealing position shown in FIG. 3*b* is performed by tensioning fixing unit 30, in this example by screwing screw 31 inside fixing unit opening 44, 54 and blind hole 64. By tensioning screw 31, tensioning element 60 is displaced relative to sealing element 50 in axial direction A. Thereby, tensioning element 60 gets in contact with sealing element 50 and applies a pressure thereon in correspondence with the tensioning force of screw 31. Particularly, several portions of sealing element 50 exhibit predefined pressure upon tensioning of tensioning element 60 against sealing element 50 such that the predefined sealing is achieved between flange assembly 10 and appliance 70, more precisely the opening of a fluid container of appliance 70. In this example, the contacting portions are substantially tapered portions 51/61 and 59/69.

It can be seen from FIG. 3*b* that tapered portion 61 overlays over tapered portion 51 when tensioning element 60 is moved against sealing element 50. Thereby, due to the form and shape of tapered portion 51 and corresponding tapered portion 61, a radially outwardly directed force is applied onto tapered portion 51. Thereby, tapered portion 51 is forced in a sealing direction, being a direction perpendicular to axial direction A and directed radially outward towards the opening of appliance 70. In other words, since tapered portion 61 is pressed against tapered portion 51, a sealing is formed between flange assembly 10 and appliance 70.

More specifically, tapered portion 51 and tapered portion 61 are in this example provided on outer peripheral side wall 55 and outer peripheral side wall 65 and thus over the entire circumferential edge of sealing element 50 and tensioning element 60, respectively. By overlaying tapered portion 61 over tapered portion 51, outer peripheral side wall 55 and thus the circumference of sealing element 50 is widened and pressed against the surface of the opening of appliance 70 such that the sealing is formed, preferably a defined sealing over the entire circumference of sealing element 50.

Further, tapered portion 69 overlays tapered portion 59 and thus forces tapered portion 59 to displace and to apply a pressure. This pressure is applied in the sealing direction, radially inwards towards screw 31. Accordingly, tapered portion 59 provides a sealing between sealing element 50 and fixing unit 30 or screw 31, respectively. Thereby, also screw 31 is held in place, such that an unintended loosening of screw 31 can be prevented.

Furthermore, by tensioning screw 31, sealing element 50 is also tensioned against cover unit 40. Accordingly, by tensioning the tensioning element 60 against sealing element 50, tapered portions 57 are pressed against cover unit 40 and deform. In other words, tapered portions 57 provide a sealing between sealing element 50 and cover unit 40.

In this example, fixing unit 30 comprises exemplarily screw 31. However, as will be seen with reference to FIGS. 6 and 7 below, also other fixing elements are contemplated by the person skilled in the art. Further, thread 36 and thread 38 are in this example provided in sealing element 50 and tensioning element 60, respectively. In other examples, blind hole 64 and fixing unit opening 54 can also be a tapped blind hole and opening, respectively, and screw 31 can be a self-cutting or self-tapping screw. Further, also other means of fixing and displacing tensioning element 60 with respect to sealing element 50 are contemplated and will exemplarily be detailed below.

Moreover, tapered portions of sealing element 50 and tensioning element 60 are shown to have substantially corresponding forms and shapes in this example. However, also different forms and shapes of tapered portions of sealing element 50 and tensioning element 60, respectively, are contemplated by the skilled person, as long as the relative movement of sealing element 50 and tensioning element 60 in axial direction A accounts for a defined displacement of said tapered portion in a sealing direction being substantially perpendicular to axial direction A.

Figure 4A:
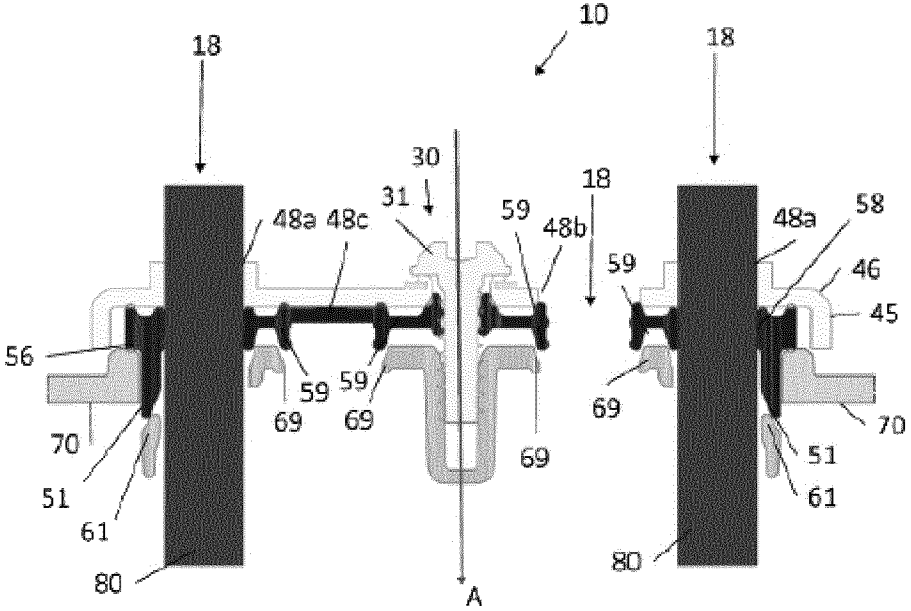
FIGS. 4*a* and 4*b* illustrate a second cross-sectional view of the flange assembly according to the present invention in a second direction in the non-sealing and the sealing and attachment position, respectively.
Figure 4B:
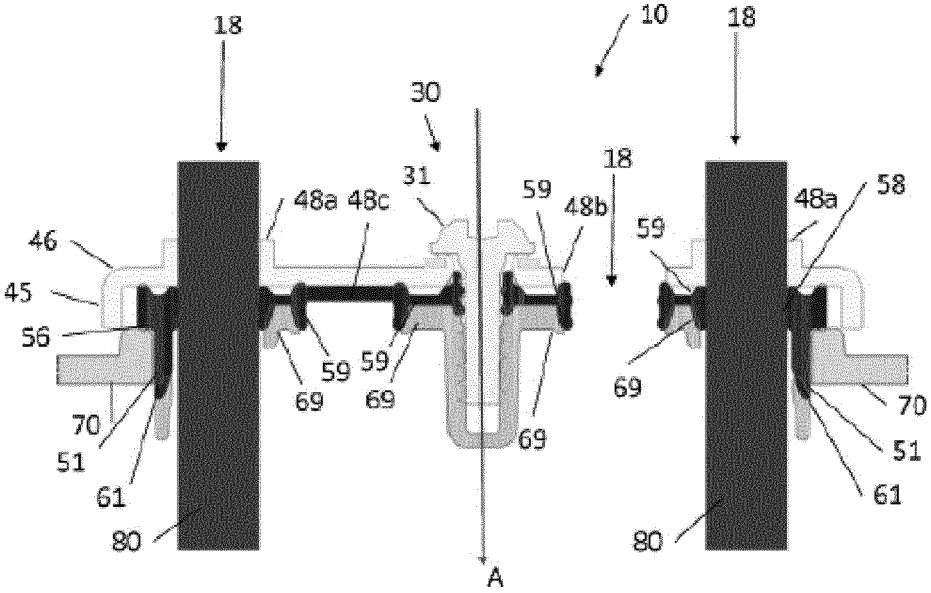

FIGS. 4*a* and 4*b* show exemplary flange assembly 10 of FIGS. 2 and 3 in the second cross-sectional direction, corresponding to the horizontal direction as seen in FIGS. 2*a* and 2*b*. Similar to FIGS. 3*a* and 3*b*, FIG. 4*a* shows flange assembly 10 in a non-sealing position and FIG. 4*b* shows flange assembly 10 in a sealing position.

In these figures, flange assembly 10 is shown mounted to appliance 70 and having heating device 80 inserted into through openings 18. Through openings 18 through which heating device 80 is inserted are formed by heating device openings 48*a* provided on base plate 42 of cover unit 40. Sealing element 50 and tensioning element 60 provide openings at positions corresponding to heating device openings 48*a* along axial direction A. Sealing element 50 comprises at the circumferential surface surrounding heating device 80 a tapered portion 59 and tensioning element 60 comprises at the position corresponding to tapered portion 59 of sealing element 50 a tapered portion 69. As can be seen from FIG. 4*b*, since tensioning element 60 is tensioned against sealing element 50, tapered portion 69 forces tapered portion 59 radially inward into through opening 18 and against heating device 80, such that heating device 80 is securely received within through opening 18 of flange assembly 10.

Another through opening 18 is provided radially inward with respect to heating device openings 48*a* through which heating device 80 is inserted. This through opening 18 is formed by temperature sensor opening 48*b* on base plate 42 of cover unit 40. Sealing element 50 and tensioning element 60 provide openings at positions corresponding to the temperature sensor opening 48*b* along axial direction A. Similar to tapered portions 59 and 69, respectively provided at sealing element 50 and tensioning element 60 adjacent heating device opening 48*a*, there are provided tapered portions 59 and 69 about through opening 18 corresponding to temperature sensor opening 48*b*. Similar to heating device 80, a temperature sensor (not shown) can thus be securely received and sealed within temperature sensor opening 48*b* by the relative movement and force of tensioning element 60 applied against sealing element 50.

Although in this example a heating device and/or a temperature sensor is intended to be inserted through one or more of through openings 18, also different devices or elements can be inserted in different applications.

In this example, tapered portion 59 is provided in the shape of a partial dual cone, that is a tapered region is formed both on the front side, i.e., the side adjacent cover unit 40, and on the rear side, i.e., the side adjacent tensioning element 60.

In addition to the sealing force induced by tapered portion 59, in this example all openings surrounding through openings 18 formed in sealing element 50 for receiving heating device 80, a temperature sensor, or a different element, respectively, are provided with one or more sealing lip 58 at the inner circumferential surface of respective tapered portion 59. Sealing lip 58 is in this example formed as an O-ring and provides for a frictional seal between sealing element 50, more precisely tapered portion 59, and the respective elements inserted therein in addition to the seal provided by the radial displacement of tapered portion 59.

In this example, at least one sealing lip 58 formed as an O-ring is provided at each of the respective tapered portions 59. However, in other examples, sealing lips 58 are not necessarily provided, can be provided only at some of the respective openings, and/or can be formed by O-rings as in this example or by different sealing elements as known in the art.

In FIG. 4*a*, there is also a blind temperature sensor opening 48*c* illustrated. Blind temperature sensor opening 48*c* is blind and no opening, as base plate 42 of cover unit 40 and sealing element 50 are not open at that position. Nevertheless, a through hole is formed in tensioning element 60 and tapered portions 59 and 69 are respectively provided in sealing element 50 and tensioning element 60 at the position corresponding to blind temperature sensor opening 48*c*. Blind temperature sensor opening 48*c* must not necessarily have a particular function, but allows for tensioning element 60 to be manufactured regularly and symmetrically, such that tensioning element 60 can be mounted on sealing element 50 in this direction or rotated about 180 degrees about a central axis, which is defined by fixing unit 30 and corresponds to the position of the arrow indicating axial direction A in the drawings, without any difficulties. In other words, blind temperature sensor opening 48*c* facilitates manufacture and allows for a symmetrical design and production of tensioning element 60.

In this example, tensioning element 60 is preferably formed of a plastics material. Further, sealing element 50 is preferably formed of an elastomeric material, such as a plastic elastomeric material. Preferably, both sealing element 50 and tensioning element 60 are manufactured by processing methods such as injection molding, as widely known in the art. However, also employing other materials and/or manufacturing processes are contemplated by the person skilled in the art.

Figure 5:
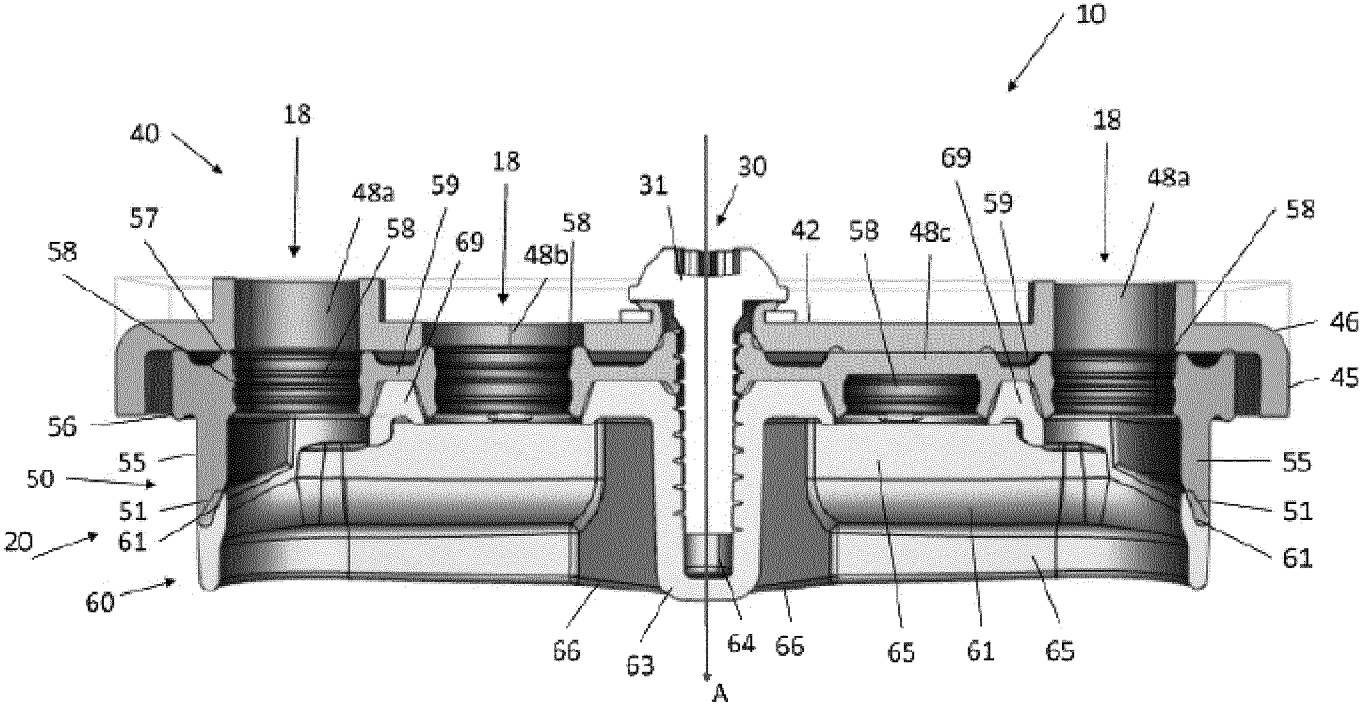
FIG. 5 illustrates an example of the flange assembly according to the invention in cross-sectional view in more detail.

FIG. 5 illustrates another cross-sectional view of exemplary flange assembly 10 according to the present invention, wherein the cross-sectional direction substantially corresponds to the direction shown in FIG. 4. However, in contrast to FIG. 4, flange assembly 10 is illustrated without appliance 70 and heating device 80 and further, also in contrast to FIG. 4, elements lying behind the cutting plane are visible. FIG. 5 depicts flange assembly 10 in the sealing position.

FIG. 5 particularly illustrates through openings 18 respectively provided for inserting heating device 80, a temperature sensor or the like. The radially outermost through openings 18 are formed by heating device opening 48*a* provided in cover unit 40, and adjacent in axial direction A openings provided in the sealing element 50 and the tensioning element 60, respectively. Heating device opening 48*a* protrudes axially to the front out of base plate 42 of cover unit 40. On the inner circumferential surface of the heating device opening in the sealing element 50, sealing lips 58 are formed. Finally, tensioning element 60 comprises tapered portion 69 which applies a force onto corresponding tapered portion 59 of sealing element 50 to provide a seal and securely receive the element within the opening 48*a*.

Similar, another through opening 18 is formed closer to fixing unit 30 than heating device opening 48*a*, formed by temperature sensor opening 48*b* of cover unit 40 and corresponding openings in the lower sealing element 50 and tensioning element 60. The same sealing is formed as described with respect to heating device opening 48*a*, namely by tapered portions 69 applying force onto corresponding tapered portions 59 and by providing one or more sealing lips 58 at the inner circumferential surface of the opening in sealing element 50. Finally, blind temperature sensor opening 48*c* has no corresponding opening formed in base plate 42. The provision thereof is for reasons of symmetry of tensioning element 60, as described above.

On the rear side of flange assembly 10, which is the side tensioning element 60 is provided at, support wall portions 66 radially outwardly protruding from fixing unit receptacle 63 are shown. Fixing unit receptacle 63 forms the envelope of blind hole 64 for receiving fixing unit 30. Support wall portions 66 transfer the pressure and/or force applied by screw 31 of fixing unit 30 onto fixing unit receptacle 63 to outer peripheral side wall 65 of tensioning element 60. Thereby, support wall portions 66 equilibrate the tension among different portions of tensioning element 60. Further, due to support wall portions 66 the need for a massive tensioning element 60 is avoided. Accordingly, is possible to save material and thus cost of tensioning element 60 and the entire flange assembly 10.

In the first example described with reference to FIGS. 2 to 5, a screw 31 interacting with the thread formed in fixing unit opening 54 and blind hole 64 has been described. However, also the use of different fixing units 30 is contemplated by a person skilled in the art and will now be described exemplarily with reference to FIGS. 6 and 7.

Figure 6:
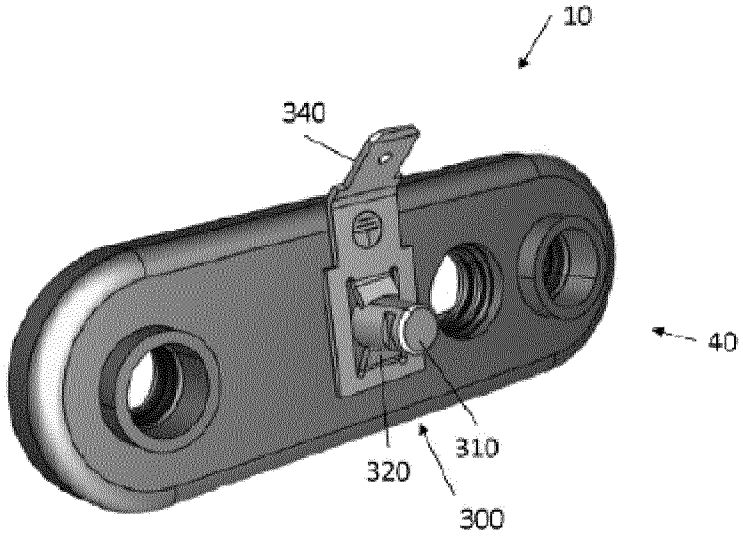
FIG. 6 illustrates an exemplary flange assembly according to the present invention with a speed nut fixing element.

FIG. 6 shows a perspective view of a modified flange assembly 10, in which fixing unit 30 has been replaced by speed nut 300. Speed nut 300 comprises two metal prongs 320 provided at ground connecting portion 34 and directed radially inward a fixing opening (provided below plain shaft of metal 310 in FIG. 6) such as to exert pressure onto plain metal shaft 310 inserted into or provided within the fixing opening. Metal prongs 320 act as a fastener that tightens by sliding cover plate 340 over plain shaft of metal 310 and thereby moving sealing element 50 relative to tensioning element 60.

Figure 7:
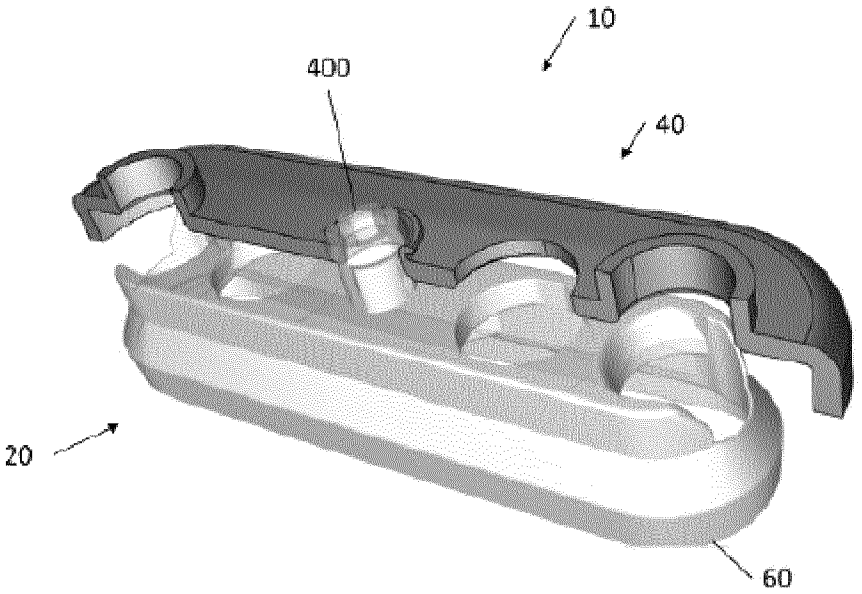
FIG. 7 illustrates an exemplary flange assembly according to the present invention with a snap-on connector between the flange unit and the cover unit.

Another embodiment of fixing unit 30 will be described with reference to FIG. 7. In this example, fixing unit 30 is provided as an integral part of flange unit 20, more precisely formed as a snap connection 400 protruding towards the front of flange assembly 10 from tensioning element 60. Snap connection 400 is arranged for snapping, such as by means of a form-fitting snapping, into a corresponding portion of cover unit 40 upon mounting of flange assembly 10 according to this example. By means of this snap connection, the predefined tensioning between tensioning element 60 and sealing element 50 can reliably be achieved, as the predetermined snapping position implies a certain predefined tension between tensioning element 60 and sealing element 50.

Although speed nut 300, snap connection 400 and screw 31 have been described as examples of the fixing unit for engaging sealing element 50 and tensioning element 60 at a predefined frictional pressure there between, also different fixing means or units are contemplated by the person skilled in the art.

Figure 8A:
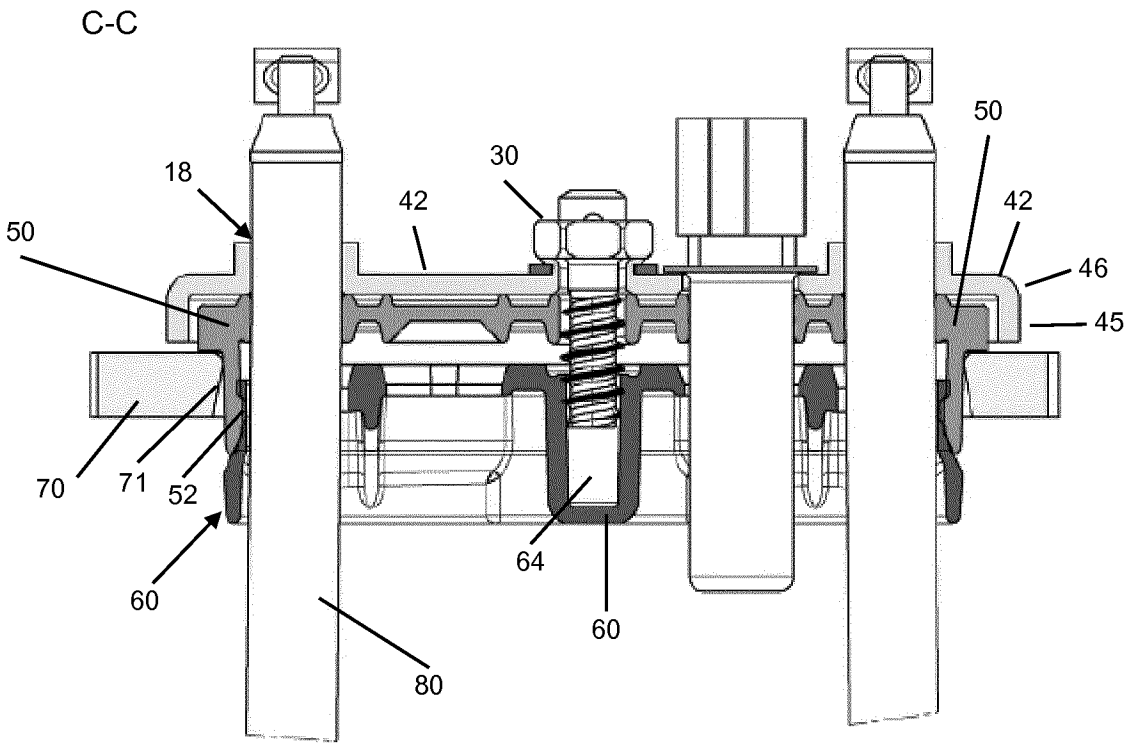
FIGS. 8*a* and 8*b* illustrate cross-sectional view of the flange assembly according to the present invention in a first and second direction in a non-sealing position, respectively.
Figure 8B:
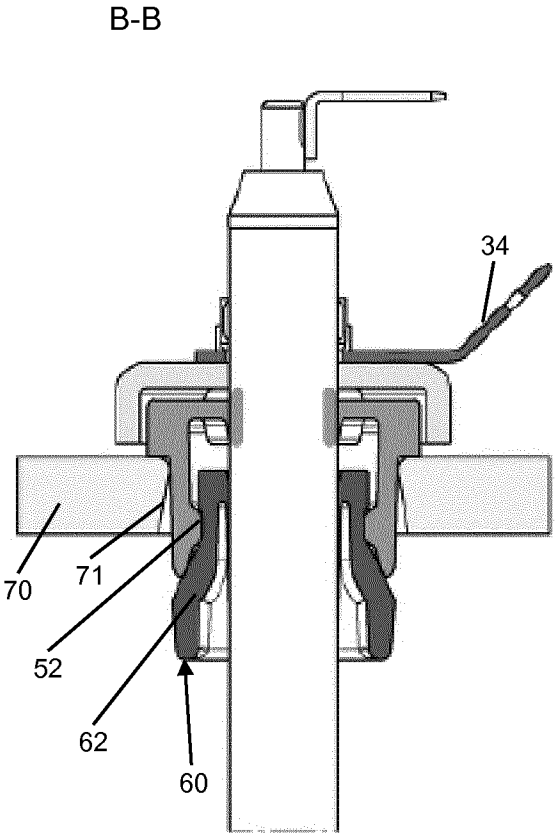

FIGS. 8*a* and 8*b* illustrate cross-sectional views along cutting lines C-C and B-B indicated in exemplary flange assembly 10 of FIG. 2*a*, wherein the flange assembly 10 is illustrated with appliance 70 and heating device 80. Further, FIGS. 8*a* and 8*b* depict flange assembly 10 in the non-sealing position. The flange assembly shown in FIGS. 8*a* and 8*b* comprises the same components as the flange assembly 10 according to FIG. 5. In the following only the differences with respect to the flange assembly 10 of FIG. 5 shall be described. In contrast to FIG. 5, appliance 70 has a beveled wall 71 in order to ease mounting of the flange assembly. In order to compensate for the missing material, sealing element 50 comprises a protruded portion 52 to engage with the tensioning element 60. Preferably, tensioning element 60 has a recessed portion 62 at the position where the protruded portion 52 of the sealing element is located in the attachment position. Furthermore, the fixing 30 element in this exemplary embodiment may only provide a sealing in a sealing direction parallel to the axial direction. However, a fixing unit 30 as shown in FIG. 5 would also be suitable.

Figure 9A:
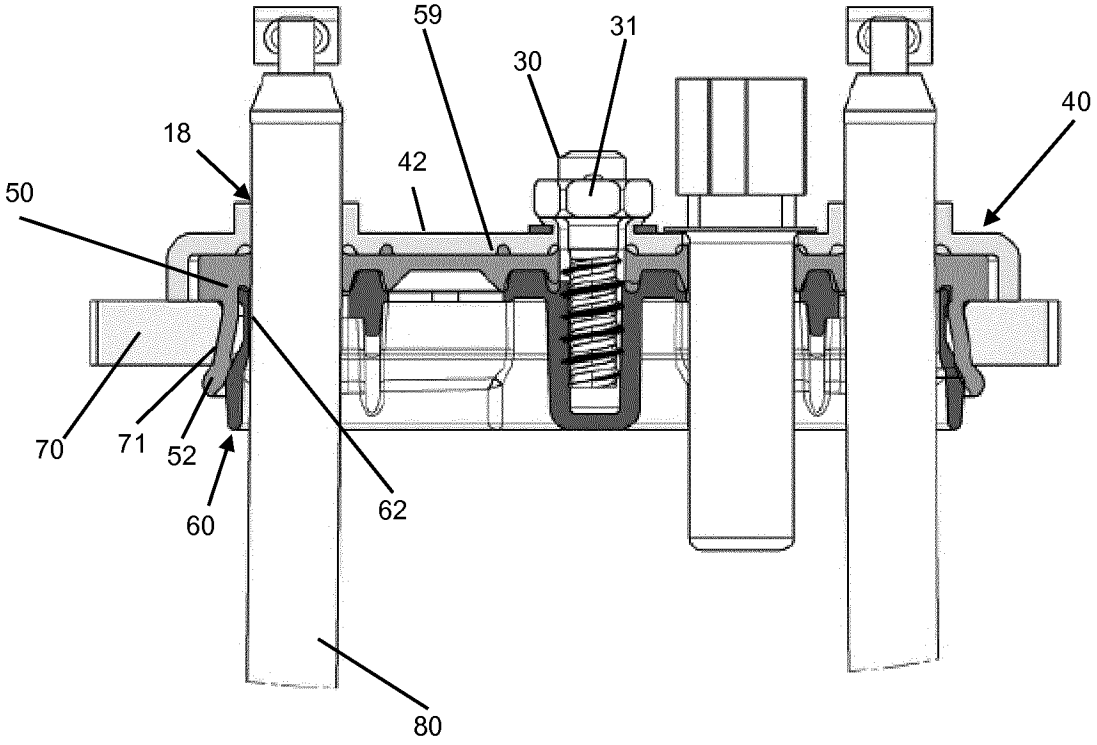
FIGS. 9*a* and 9*b* illustrate cross-sectional view of the flange assembly according to the present invention in a first and second direction in a sealing and attachment position, respectively.
Figure 9B:
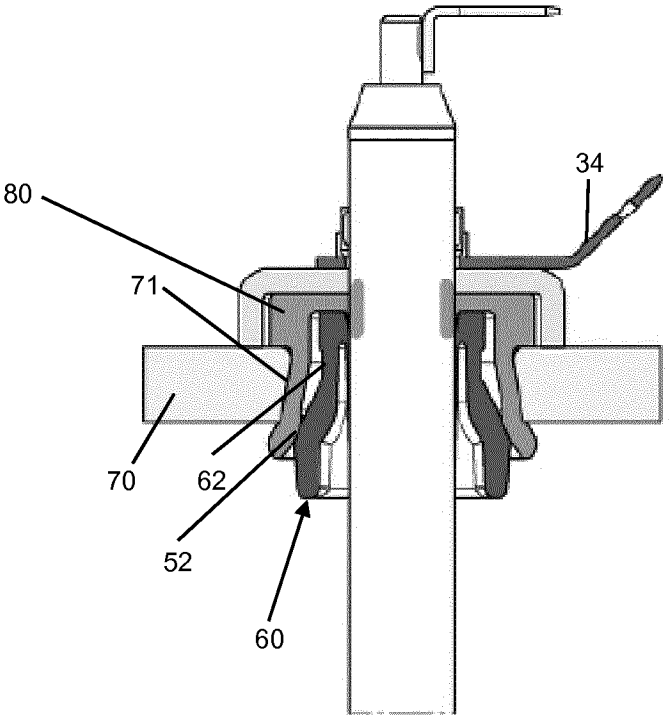

FIGS. 9*a* and 9*b* illustrate the flange assembly 10 shown in FIGS. 8*a* and 8*b* in the sealing and attachment position. Due to the protruded portion 52 of the sealing element 50 which engages with the tensioning element 60, the sealing element 50 engages with the beveled wall 71 of appliance 70 and thus compensates for the missing material of the beveled wall 71.

In order to strengthen the positioning of the sealing element 50, the tensioning element 60 may be provided with more material wherever appropriate, in particular at the through openings 18 where the heating device is inserted. Furthermore, stiffening rips may be provided at the tensioning element 60.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A flange assembly for holding a heating device to a fluid container of an appliance accommodating a fluid to be heated, comprising:

a flange unit arranged for being mounted to an opening of the fluid container by at least one fixing unit and having a non-sealing and a sealing and attachment position, wherein the flange unit is reversibly moveable from the non-sealing to the sealing and attachment position by the fixing unit for being configured to engage the opening of the fluid container in the sealing and attachment position, wherein the flange unit comprises a sealing element and a tensioning element, wherein the sealing element and the tensioning element are moveable relative to each other in an axial direction by the fixing unit such that the sealing element and the tensioning element can be pressed against each other, wherein the sealing element and the tensioning element are, in the sealing and attachment position, arranged to provide a sealing in a sealing direction perpendicular to the axial direction, wherein the sealing element and the tensioning element of the flange unit each comprise at least one tapered portion, wherein, in the non-sealing position, the at least one tapered portion of the tensioning element overlays the at least one tapered portion of the sealing element in the axial direction;

wherein the flange unit comprises at least one through opening extending through the sealing element and the tensioning element in the axial direction for receiving and holding an element;

wherein the at least one tapered portion of the sealing element surrounds the through opening and the sealing element is arranged such that, in the sealing and attachment position, a defined displacement of the at least one tapered portion of the sealing element in the sealing direction holds the heating device or a temperature sensor within the through opening; and wherein the at least one tapered portion of the sealing element comprises a sealing lip, provided at the inner peripheral surface of the at least one through opening.

2. A flange assembly for holding a heating device to a fluid container of an appliance accommodating a fluid to be heated, comprising:

a flange unit arranged for being mounted to an opening of the fluid container by at least one fixing unit and having a non-sealing and a sealing and attachment position, wherein the flange unit is reversibly moveable from the non-sealing to the sealing and attachment position by the fixing unit for being configured to engage the opening of the fluid container in the sealing and attachment position, wherein the flange unit comprises a sealing element and a tensioning element, wherein the sealing element and the tensioning element are moveable relative to each other in an axial direction by the fixing unit such that the sealing element and the tensioning element can be pressed against each other, wherein the sealing element and the tensioning element are, in the sealing and attachment position, arranged to provide a sealing in a sealing direction perpendicular to the axial direction, wherein the sealing element and the tensioning element of the flange unit each comprise at least one tapered portion, wherein, in the non-sealing position, the at least one tapered portion of the tensioning element overlays the at least one tapered portion of the sealing element in the axial direction;

wherein the flange unit comprises at least one through opening extending through the sealing element and the tensioning element in the axial direction for receiving and holding an element:

wherein the at least one tapered portion of the sealing element surrounds the through opening and the sealing element is arranged such that, in the sealing and attachment position, a defined displacement of the at least one tapered portion of the sealing element in the sealing direction holds the heating device or a temperature sensor within the through opening;

wherein the sealing element comprises a fixing unit opening and the tensioning element comprises a blind hole, at corresponding positions along the axial direction for receiving at least part of the fixing unit therein; and wherein the fixing unit is arranged to provide a sealing in a sealing direction parallel to the axial direction.

3. A flange assembly for holding a heating device to a fluid container of an appliance accommodating a fluid to be heated, comprising:

a flange unit arranged for being mounted to an opening of the fluid container by at least one fixing unit and having a non-sealing and a sealing and attachment position, wherein the flange unit is reversibly moveable from the non-sealing to the sealing and attachment position by the fixing unit for being configured to engage the opening of the fluid container in the sealing and attachment position, wherein the flange unit comprises a sealing element and a tensioning element, wherein the sealing element and the tensioning element are moveable relative to each other in an axial direction by the fixing unit such that the sealing element and the tensioning element can be pressed against each other, wherein the sealing element and the tensioning element are, in the sealing and attachment position, arranged to provide a sealing in a sealing direction perpendicular to the axial direction, wherein the sealing element and the tensioning element of the flange unit each comprise at least one tapered portion, wherein, in the non-sealing position, the at least one tapered portion of the tensioning element overlays the at least one tapered portion of the sealing element in the axial direction;

wherein the flange unit comprises at least one through opening extending through the sealing element and the tensioning element in the axial direction for receiving and holding an element;

wherein the at least one tapered portion of the sealing element surrounds the through opening and the sealing element is arranged such that, in the sealing and attachment position, a defined displacement of the at least one tapered portion of the sealing element in the sealing direction holds the heating device or a temperature sensor within the through opening;

wherein the sealing element comprises a fixing unit opening and the tensioning element comprises a blind hole, at corresponding positions along the axial direction for receiving at least part of the fixing unit therein; and wherein the at least one tapered portion of the sealing element is arranged around the fixing unit opening and to displace radially to the inside of the fixing unit opening upon relative movement between the sealing element and the tensioning element.

* * * * *